US005437576A

United States Patent [19]

Tuten et al.

[11] Patent Number: 5,437,576

[45] Date of Patent: Aug. 1, 1995

[54] COMBINATION BOWLING PINSPOTTER AND PINSPOTTER CONTROL SYSTEM AND METHOD THEREFOR

[75] Inventors: William J. Tuten; Kennith D. Crosby, both of Scottsdale, Ariz.

[73] Assignee: Creative Technology, Inc., Scottsdale, Ariz.

[21] Appl. No.: 148,317

[22] Filed: Nov. 8, 1993

[51] Int. Cl.[6] ..... A63D 5/00

[52] U.S. Cl. ..... 473/65; 473/66; 473/67; 473/101; 473/93; 340/323 B

[58] Field of Search ..... 473/65-67, 473/72, 101, 93, 64; 340/323 B; 364/410

[56] References Cited

U.S. PATENT DOCUMENTS

| | | | |
|---|---|---|---|
| 2,705,146 | 3/1955 | Montooth et al. | 473/65 |
| 2,890,886 | 6/1959 | Dumas | 473/65 |
| 3,231,272 | 1/1966 | Blewitt, Jr. | 473/72 |
| 3,239,222 | 3/1966 | Sanders et al. | 473/65 |
| 3,240,493 | 3/1966 | Cohen | 473/66 |
| 3,795,402 | 3/1974 | Bolger et al. | 473/101 |
| 4,133,042 | 1/1979 | Wallace | 473/65 |
| 4,148,481 | 4/1979 | Smith-Vaniz | 473/101 |
| 4,151,993 | 5/1979 | Payne et al. | 473/66 |
| 4,350,337 | 9/1982 | Knauer et al. | 473/66 |
| 4,592,548 | 6/1986 | Oldson | 473/65 |

*Primary Examiner*—Vincent Millin
*Assistant Examiner*—Kerry Owens
*Attorney, Agent, or Firm*—Harry M. Weiss; Jeffrey D. Moy

[57] ABSTRACT

A combination bowling pinspotter and pinspotter control chassis system is disclosed which provides a bowling pinspotter having circuitry for permitting the spotting of bowling pins and an all solid state pinspotter control chassis coupled to the pinspotter for controlling the operation of the pinspotter. The all solid state pinspotter controller provides circuitry for executing a short strike cycles. In addition, the pinspotter controller secures power to a back end motor of the pinspotter in order to conserve the energy consumed by the back end motor. The pinspotter controller provides circuitry coupled to a remote control console for permitting the pinspotter to complete a current cycle prior to executing a shut down command for the pinspotter from the remote control console. In addition, the all solid state pinspotter controller retains status and position data for the pinspotter during power interrupts.

20 Claims, 6 Drawing Sheets

COMBINATION BOWLING PINSPOTTER AND PINSPOTTER CONTROL SYSTEM AND METHOD THEREFOR

FIELD OF THE INVENTION

This invention relates generally to bowling systems and, more specifically, to a combined bowling pinspotter and pinspotter control system and method therefor which provides an all solid state pinspotter control system that provides a plurality of new and enhanced pinspotter control functions.

DESCRIPTION OF THE PRIOR ART

The pinspotters from the late 1940's and the early 1950's were designed to replace older manual pinspotters with newer, automatic pinspotters such as the AMF 5850/6525 models that were more reliable, functional, accurate, and efficient. These electro-mechanical pinspotter controllers replaced the earlier mechanical pinspotter controllers such as the AMF 4400 system. Regardless of which of these prior art pinspotter controllers were used, there were several significant functional limitations. For example, at the end of working hours, a bowling alley manager will obviously turn off each pinspotter, however, securing power to a pinspotter that is in the middle of executing a cycle can cause damage to the pinspotter when power is returned. Also, bowling alley managers sometimes accidently turn off pinspotters in the middle of a cycle. Consequently, the next time that these pinspotters are turned on, their response is unpredictable, and in some cases, damaging to the equipment. Therefore, it would be desirable to have a pinspotter controller that automatically finishes its current cycle when the unit is shut down. In addition, when all power to a pinspotter controller is interrupted during a power outage, it would be desirable for the system to be able to recall its last status and position so that the pinspotter is smoothly and safely returned to service. Prior art pinspotter controllers did not have these capabilities, therefore, a need existed to create an all solid state pinspotter controller that overcame these and other shortcomings of the prior art pinspotter controllers.

SUMMARY OF THE INVENTION

In accordance with one embodiment of this invention, it is an object of this invention to provide a combined bowling pinspotter and pinspotter control system and method therefor.

It is another object of this invention to provide an all solid state pinspotter control system.

It is a further object of this invention to provide an all solid state pinspotter control system that retains pinspotter status and position data during power interrupts.

It is yet another object of this invention to provide an all solid state pinspotter control system for use with at least the AMF 8230 pinspotter models 5850 and 6525.

BRIEF DESCRIPTION OF THE PREFERRED EMBODIMENTS

In accordance with one embodiment of this invention, a combination bowling pinspotter and pinspotter control chassis system is disclosed comprising, in combination, a bowling pinspotter having circuit means therein for permitting the spotting of bowling pins, and control chassis means having all solid state components and being coupled to the pinspotter for controlling the operation of the pinspotter comprising, in combination, means coupled to the control chassis for executing a short strike cycle, means coupled to a back end motor of the pinspotter for conserving the energy consumed by the back end motor, means coupled to a remote control console for permitting the pinspotter to complete a current cycle prior to executing a shut down command for the pinspotter from the remote control console, and means coupled to the control chassis for permitting the control chassis to retain status and position data for the pinspotter during a power interrupt. This system further includes scoring interface means coupled to the control chassis for permitting the control chassis to maintain scores for both AMF and Brunswick type scoring systems. In addition, this system includes means coupled to the control chassis for controlling the operation of a sweep and a table of the pinspotter. The control chassis further includes means coupled to a pin feeding mechanism of the pinspotter for controlling the loading of pins into the pinspotter. This embodiment of the system further includes means coupled to the control chassis for permitting a user to shift from a first ball cycle to a second ball cycle and from the second ball cycle to the first ball cycle. This system also includes means coupled to the control chassis for inhibiting a foul cycle, for permitting a supervisor to cycle the pinspotter between a bowl mode and an instructo-mat mode, and for inhibiting the instructo-mat mode. In addition, this system includes means coupled to the control chassis for providing electrical current overload protection for the control chassis. This system further includes interlock control means coupled to the pinspotter for preventing the pinspotter from hitting and damaging the sweep wherein the interlock control means also prevents simultaneous energizing of a first motor for the sweep and a second motor for the pinspotter. The interlock control means also prevents the pinspotter from hitting and damaging itself or a bowling pin.

In accordance with another embodiment of this invention, a combination AMF 8230 bowling pinspotter and pinspotter control chassis system is disclosed comprising, in combination, an AMF 8230 bowling pinspotter having circuit means therein for permitting the spotting of bowling pins, and control chassis means having all solid state components and being coupled to the pinspotter for controlling the operation of the pinspotter comprising, in combination, means coupled to the control chassis for executing a short strike cycle, means coupled to a back end motor of the pinspotter for conserving the energy consumed by the back end motor, means coupled to a remote control console for permitting the pinspotter to complete a current cycle prior to executing a shut down command for the pinspotter from the remote control console, and means coupled to the control chassis for permitting the control chassis to retain status and position data for the pinspotter during a power interrupt.

In accordance with yet another embodiment of this invention, a method of operating a combination bowling pinspotter and pinspotter control chassis system is provided comprising the steps of providing a bowling pinspotter having circuit means therein for permitting the spotting of bowling pins, and providing control chassis means having all solid state components and being coupled to the pinspotter for controlling the operation of the pinspotter comprising the steps of providing means coupled to the control chassis for executing a short strike cycle, providing means coupled to a back end motor of the pinspotter for conserving the energy consumed by the back end motor, providing means coupled to a remote control console for permitting the pinspotter to complete a current cycle prior to executing a shut down command for the pinspotter from the remote control console, and providing means coupled to the control chassis for permitting the control chassis to retain status and position data for the pinspotter during a power interrupt. This method further includes scoring interface means coupled to the control chassis for permitting the control chassis to maintain scores for both AMF and Brunswick type scoring systems. Moreover, this method includes means coupled to the control chassis for controlling the operation of a sweep and a table of the pinspotter. The control chassis further includes means coupled to a pin feeding mechanism of the pinspotter for controlling the loading of pins into the pinspotter. This method also includes means coupled to the control chassis for permitting a user to shift from a first ball cycle to a second ball cycle and from the second ball cycle to the first ball cycle. In addition, this method includes means coupled to the control chassis for inhibiting a foul cycle, for permitting a supervisor to cycle the pinspotter between a bowl mode and an instructo-mat mode, and for inhibiting the instructo-mat mode. This method further includes means coupled to the control chassis for providing electrical current overload protection for the control chassis. In addition, this method includes interlock control means coupled to the pinspotter for preventing the pinspotter from hitting and damaging the sweep. The interlock control means also prevents simultaneous energizing of a first motor for the sweep and a second motor for the pinspotter. The interlock control means also prevents the pinspotter from hitting and damaging itself or a bowling pin.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENT

Figure 1:
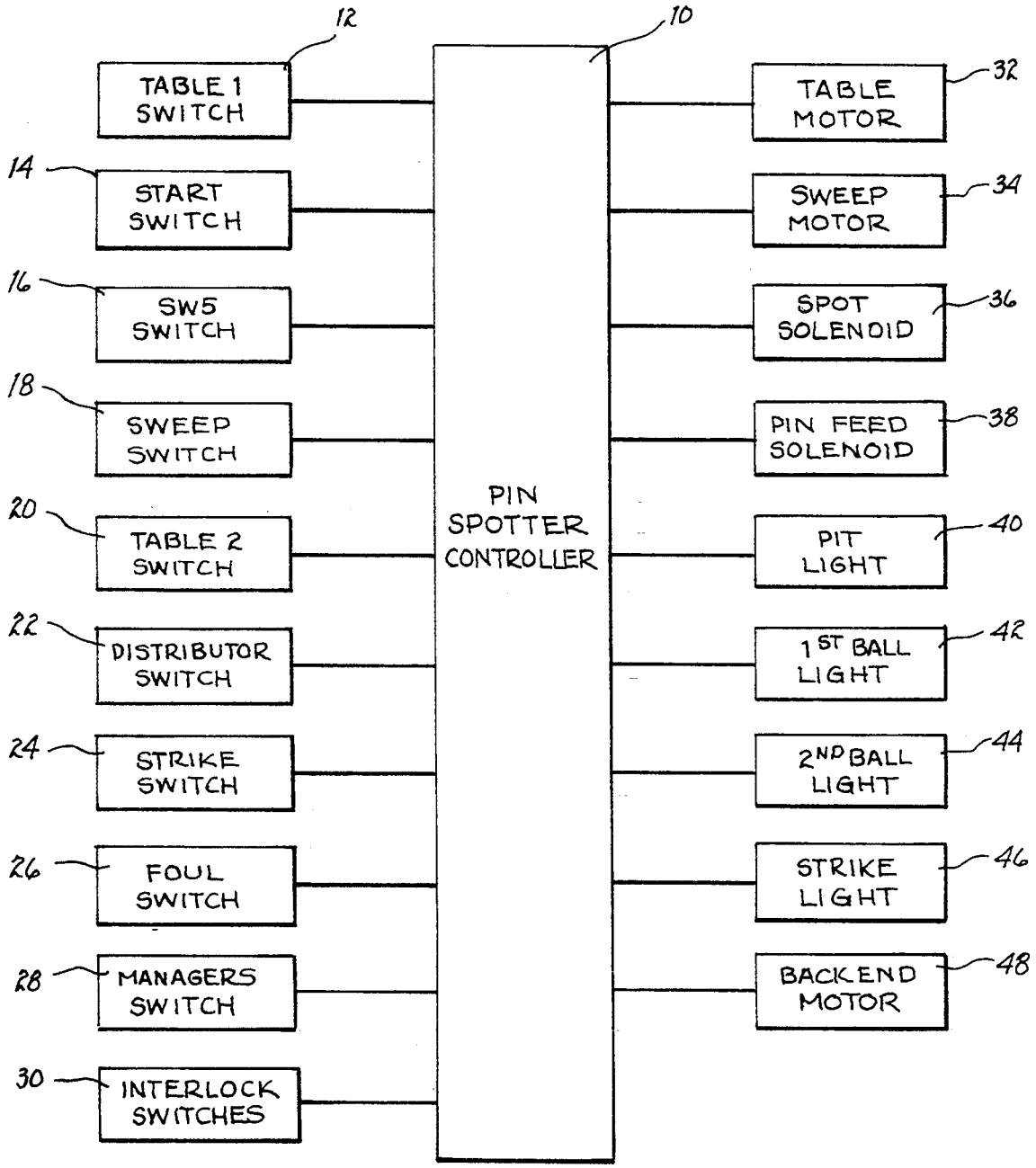
FIG. 1 is a simplified block diagram showing the inputs to and the outputs from the all solid state pinspotter controller.

Referring to FIG. 1, the all solid state pinspotter control chassis or pinspotter controller is shown and is generally designated by reference number 10. Note that, in general, the pinspotter controller 10 can be integrated with any pinspotter, however, this pinspotter controller 10 is typically used with the AMF 8230 pinspotter models 5850 and 6525.

A plurality of input switches 12–30 are coupled to provide input signals to the pinspotter controller 10. The TABLE1 switch 12 identifies the position of the pinspotter table. The START switch 14 sends a START signal to the pinspotter controller 10 to identify when a bowling ball has impacted a back cushion which is located behind the bowling pins. The START signal tells the pinspotter controller 10 to initiate a cycle. The SW5 switch 16 tells the pinspotter controller 10 when the pin feeding mechanism counter is at a "zero" position, and typically, this "zero" position corresponds to the 7th pin position. Note that the 7th pin position is the rear, left bowling pin. The SWEEP switch 18 identifies the position of the sweep to the pinspotter controller 10. The TABLE2 switch 20 is identical to the TABLE1 switch 12, and it can function as a spare switch if the TABLE1 switch 12 fails. The DISTRIBUTOR switch 22 tells the pinspotter controller 10 when the distributor arm of the pin feeding mechanism is at the 7th pin position. After a strike, the STRIKE switch 24 indicates that no bowling pin gripper in the pinspotter has picked up a pin, and that therefore, a strike has occurred. The FOUL switch 26 tells the pinspotter controller 10 to start a foul cycle in response to a bowler's foul. The MANAGERS switch 28 is a three position switch that is typically operated from a remote console from which the manager can control the status of any pinspotter in the bowling alley. The three options of the Managers switch 28 are to 1) turn on the pinspotter to allow normal bowling, this is the bowl position, 2) turn off the pinspotter, or 3) instructo-mat position. In the instructo-mat position, no pins are set, and the pinspotter is idle so that a bowler can practice bowling without pins. As an added benefit, since the pinspotter is idle during the instructo-mat mode, neither the bowler nor the bowling alley are charged for cycling the pinspotter since it does not cycle. The INTERLOCK switches 30 provide warning signals to the pinspotter controller 10 to protect the pinspotter from damaging itself. For example, if the pinspotter attempts to pick up a bowling pin that is misaligned with the pinspotter, the pinspotter may crush the pin, damage the floor, or even damage itself. As another example, if the pinspotter attempts to move downward when the sweep is underneath the pinspotter, then obviously, the sweep, the floor, or the pinspotter could be damaged. Consequently, instruments such as strain gages are located in critical safety locations near and/or on the pinspotter in order to provide warning signals to the pinspotter controller 10 via the INTERLOCK switches 30.

Again referring to FIG. 1, a plurality of outputs are provided by the pinspotter controller 10 in order to drive the loads 32–48. The table motor 32 drives the table up and down, and controls the picking up, placing, and spotting of the bowling pins. The sweep motor 34 drives the sweep in order to clear the floor of fallen pins so that either the standing pins or a new set of pins can be set on the floor. When activated, the spot solenoid 36 causes the pinspotter table to spot a new set of pins on the pin deck or floor. The pin feed solenoid 38 allows the pin feeding mechanism to load the pinspotter with a new set of pins. The pit light 40 illuminates the pin deck. The 1st ball light 42 indicates that the pinspotter controller 10 is anticipating the first ball. Note that the 1st ball light 42 stays lit for both the first and second bowling balls. The 2nd ball light 44 indicates that the pinspotter controller 10 is anticipating the second ball, and the 2nd ball light 44 is lit for only the second ball. The strike light 46 indicates that the pinspotter controller 10 has recognized that all of the bowling pins were knocked down with the first ball. Once the bowling pins have been swept back and off of the floor, the back end motor 48 drives an elevator mechanism in order to pick up the bowling pins and deliver them to the distributor mechanism which subsequently feeds the pins to the pinspotter. Note that the pinspotter controller 10 monitors the operation of the back end motor 48 so that when the motor 48 has been running for a predetermined amount of time without picking up pins, power to the motor 48 is secured until such time as it is required.

Figure 2:
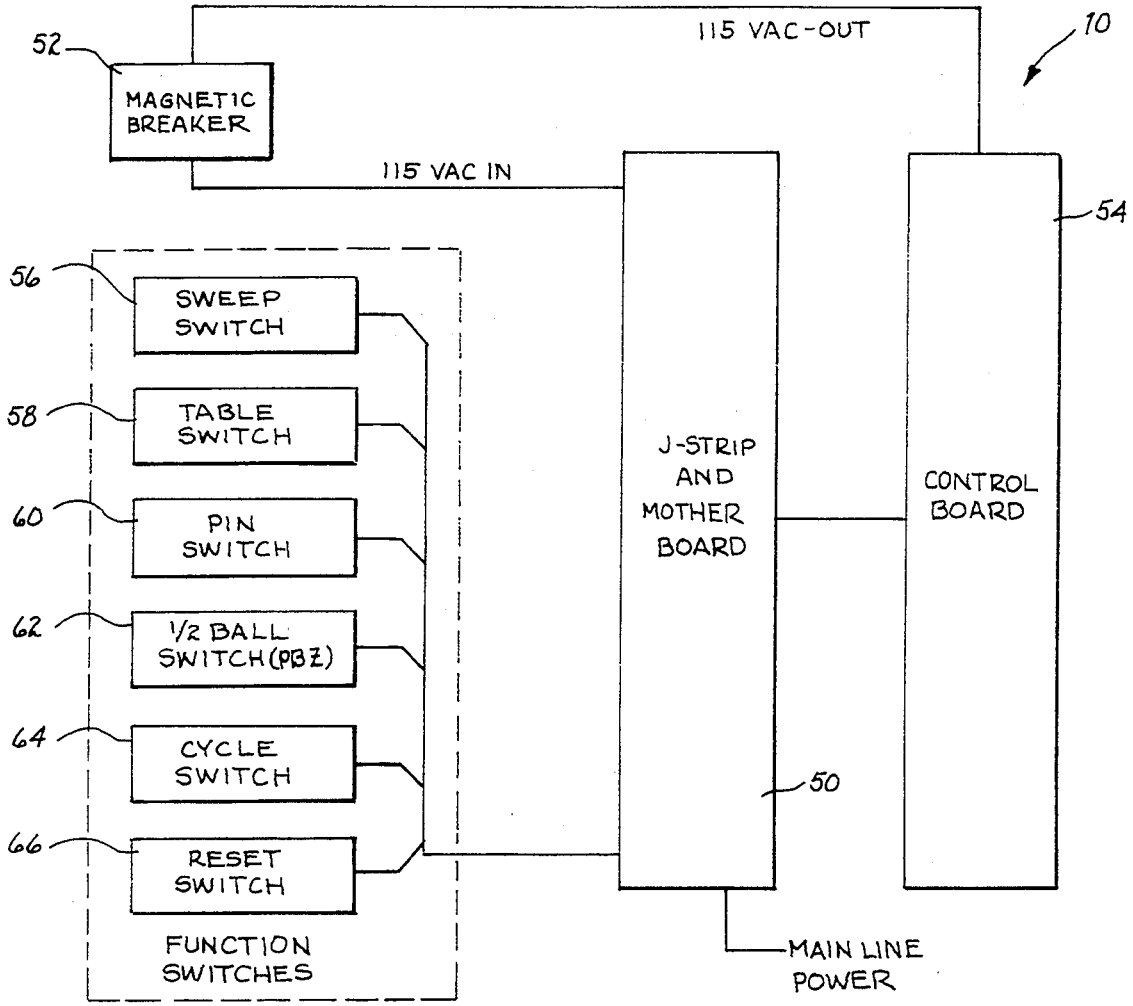
FIG. 2 is a more detailed block diagram of the all solid state pinspotter controller.
Figure 3:
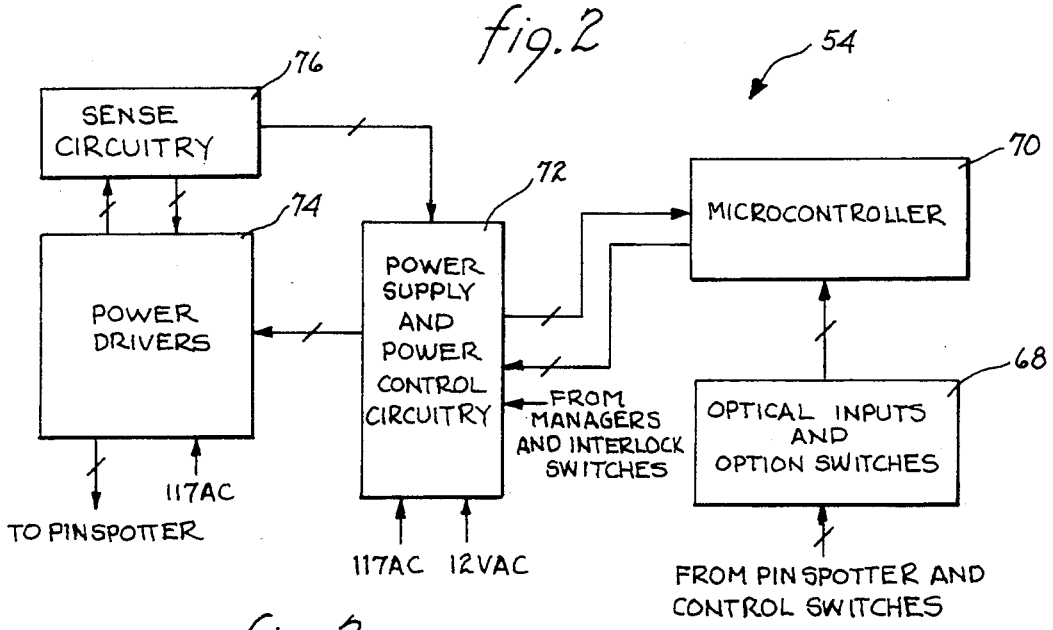
FIG. 3 is a simplified block diagram of the control board shown in FIG. 2.
Figure 4:
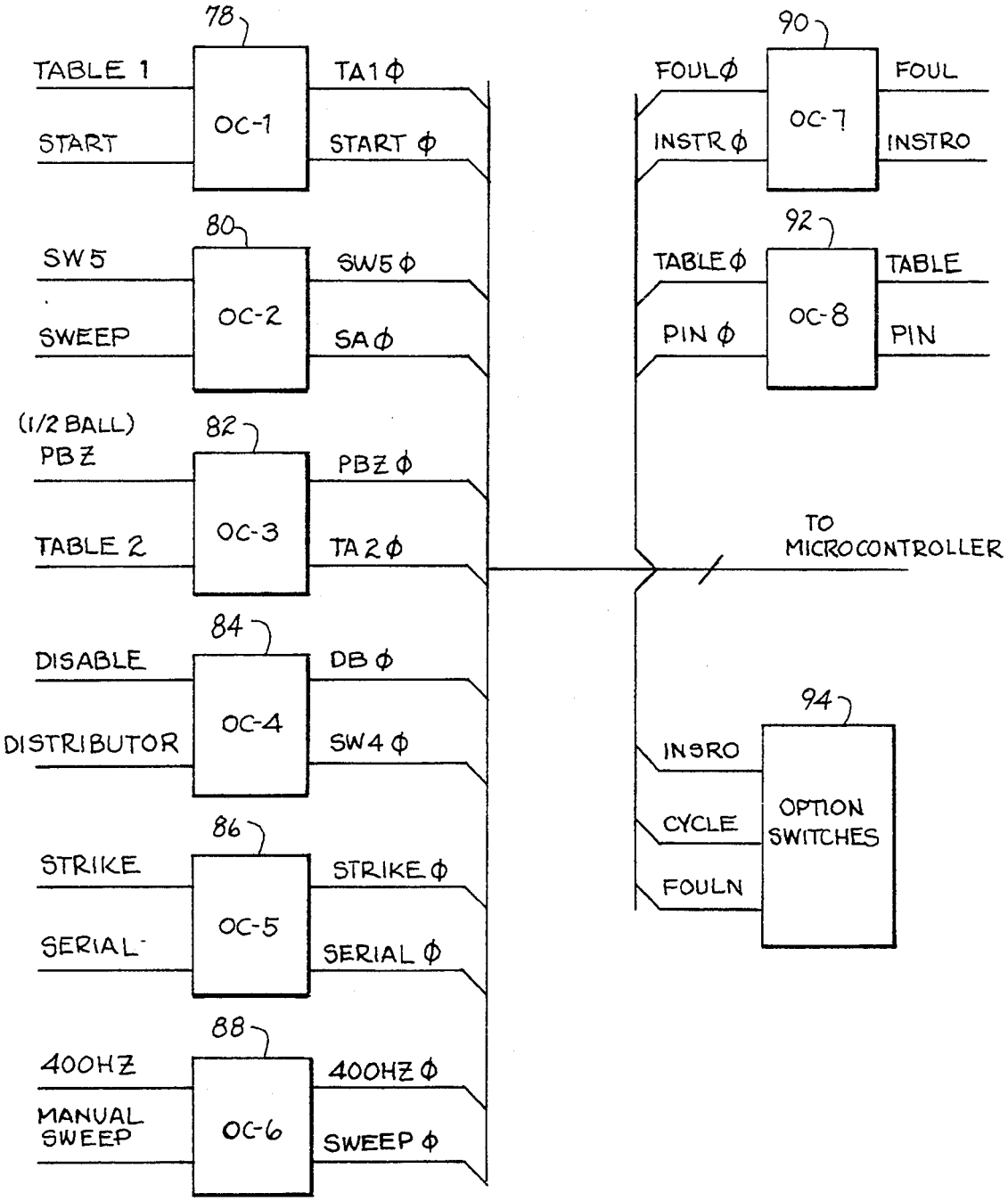
FIG. 4 is a more detailed block diagram of the optical inputs and the option switches that are input to the micro-controller shown in FIG. 3.

Referring to FIG. 2, a more detailed block diagram of the all solid state pinspotter controller 10 from FIG. 1 is shown. Main line power is supplied to the pinspotter controller via the J-strip/mother board 50. The J-strip/-mother board 50 provides a plurality of connector pins (not shown) that are plugged into an interface strip for the pinspotter. A magnetic type breaker 52 delivers 115 VAC electrical power from the J-strip/mother board 50 to the control board 54. The magnetic breaker 52 controls all power to the pinspotter. Note that the J-strip/mother board 50 is coupled to the control board 54 which contains the majority of the control electronics for the pinspotter controller 10. A plurality of option switches and a plurality of LED indicators are not shown in this diagram, but they are integral to the control board 54. The option switches are shown in FIGS. 3 and 4. The control board 54 LED indicators are not shown for the sake of simplification of the drawing, however, the LED indicators include each of a TABLE, SWEEP, 1ST BALL, 2ND BALL, STRIKE, POWER, FOUL, and INSTRUCTO LED. The LED indicators are driven by the control board 54. The mother board also includes an interface for an exterior sensor, such as from a radar type system, that determines if all of the pins have been knocked down. When this exterior sensor detects a strike, it sends a short strike signal to the control board 54 via this interface with the J-strip/mother board 52. The control board 54 uses this SHORT STRIKE-signal to initiate sweeping the fallen pins, scoring a strike, and setting up for the first ball of the next frame. The advantage of having this short strike system is that the pinspotter does not need to move down to sense that a strike has occurred, therefore unnecessary pinspotter cycles are avoided. This short strike interface with the J-strip/mother board 52 is not shown for the sake of simplifying the drawing.

A plurality of function switches 56–66 are coupled to the mother board which couples the data from these switches 56–66 to the control board 54. These function switches 56–66 are typically used by a pinspotter technician to manually operate various functions of the pinspotter. In particular, the SWEEP switch 56 run the sweep motor causing the sweep to cycle through its field of motion. The TABLE switch 58 causes the table motor to cycle the pinspotter table through its field of motion. The PIN switch 60 causes the pin feeding mechanism to load the pinspotter with bowling pins, or alternatively, the PIN switch 60 can cause the pin feeding mechanism to secure loading the pinspotter. The ½ BALL switch 62 provides either a first ball signal or a second ball signal to the pinspotter controller 10 in order to simulate these conditions. The CYCLE switch 64 provides a start signal to the pinspotter controller 10 to imitate the actual START switch 14 signal that is automatically provided once a ball has cleared the pins. The RESET switch 66 causes the pinspotter controller 10 to place the pinspotter in its zero condition which is defined as having the table and the sweep up.

Referring to FIG. 3, a simplified block diagram of the components from the control board 54 of FIG. 2 is shown. A bank of optical inputs and options switches 68 are input to a micro-controller 70. The micro-controller 70 is preferably a Motorola 68HC05 micro-controller although other micro-controllers may be substituted, if desired. The micro-controller 70 is uniquely programmed to execute the numerous functions of the pinspotter controller 10, and, in particular, the micro-controller 70 is programmed to ensure that the pinspotter and pinspotter controller 10 complete any currently running cycle prior to executing a shut down command. The micro-controller 70 is coupled to the power supply and power control circuitry 72 which is coupled to the power drivers 74 and the sense circuitry 76. Note that the output from the INTERLOCK switches 30 and two of the three outputs from the MANAGERS switch 28 are coupled to the power supply and power control circuitry 72. Specifically, the off position and the bowl position of the MANAGERS switch 28 are coupled to the power supply and power control circuitry 72.

Referring to FIG. 4, a more detailed view of the optical and the option switch inputs to the micro-controller 70 from the optical inputs and options switches 68 in FIG. 3 is shown. A plurality of optical couplers (OC) 78–92 couple their respective inputs with the micro-controller 70. Note that the option switches 94 also provide signals to the micro-controller 70. The TABLE1 signal is input from the TABLE1 switch 12 to OC-1 from which the TA10 signal is delivered to the micro-controller 70. The START signal is input from either the START switch 14 from FIG. 1 or the CYCLE switch 64 from FIG. 2 to OC-1 from which the START0 signal is delivered to the micro-controller 70. The SW5 signal is input from the SW5 switch 16 to OC-2 from which the SW50 signal is delivered to the micro-controller 70. The SWEEP signal Is input from the SWEEP switch 18 to 0C-2 from which the SA0 signal is delivered to the micro-controller 70. The PBZ (½ BALL) signal is input from the PBZ switch 62 to OC-3 from which the PBZ0 signal is delivered to the micro-controller 70. The TABLE2 signal is input from the TABLE2 switch 20 to OC-3 from which the TA20 signal is delivered to the micro-controller 70. The DISABLE signal is input to OC-4 from the sweep and table enable 104 of FIG. 6, and the output signal DIS0 is delivered to the micro-controller 70. When the DISABLE signal is active high, the micro-controller 70 temporarily ceases operation. The DISTRIBUTOR signal is input from the DISTRIBUTOR switch 22 to OC-4 from which the SW40 signal is delivered to the micro-controller 70. The STRIKE signal from the STRIKE switch 24 is input to OC-5 from which the STRIKE0 signal is delivered to the micro-controller 70. The SERIAL signal and the 400 HZ signal come from the external short; strike sensor (not shown) that detects when all the pins are knocked down. When a strike has occurred, the short strike sensor sends the SERIAL signal, which is strobed through OC-5 by the 400 HZ clock signal, to cause the micro-controller 70 to drive the sweep to clear the floor of fallen pins, to drive the pinspotter to spot a new set of pins, and to prepare the pinspotter for the first ball of a the next frame. The optical coupler OC-5 sends the SERIAL signal as SERIAL0 to the micro-controller 70, and OC-6 directs the 400 HZ signal as 400 HZ0 to the micro-controller 70. The MANUAL SWEEP signal from the SWEEP switch 56 is input to OC-6 from which the SWEEP0 signal is delivered to the micro-controller 70. The FOUL signal from the FOUL switch 26 is input to OC-7 from which the FOUL0 signal is delivered to the micro-controller 70. Recall that the Managers switch 28 is a three position switch that is typically operated from a remote console from which the manager can control the status of any pinspotter in the bowling alley. The three options of the Managers switch 28 are to 1) turn on the pinspotter to allow normal bowling, this is the bowl position, 2) turn off the pinspotter, or 3) instructo-mat position. In the instructo-mat position, no pins are set, and the pinspotter is idle so that a bowler can practice bowling without pins. Positions 1 and 2 of the Manager's switch are input to the power supply and power control circuitry 72 (see FIG. 3) from where these inputs are coupled to the pinspotter micro-controller 70. The instructo-mat position of the Manager's switch 28 delivers the INSTRO signal to OC-7 in order to provide the INSTRO0 signal for the micro-controller 70. The TABLE switch 58 provides the input signal TABLE to OC-8 from where the TABLE0 signal is delivered to the micro-controller 70. The PIN switch 60 provides the input signal PIN to 0C-8 from where the PIN0 signal is delivered to the micro-controller 70. The option switches 94 provide the INSRO, CYCLE, and FOULN signals to the micro-controller 70. The option switch providing the INSRO signal is used to disable the intructo-mat option. When the CYCLE option switch is on, the manager can cycle the pinspotter by going from the bowl position to the instructo-mat position and then back to the bowl position on the Manager's switch 28. When the FOULN option switch is on, the normal foul cycle is disabled.

Figure 5:
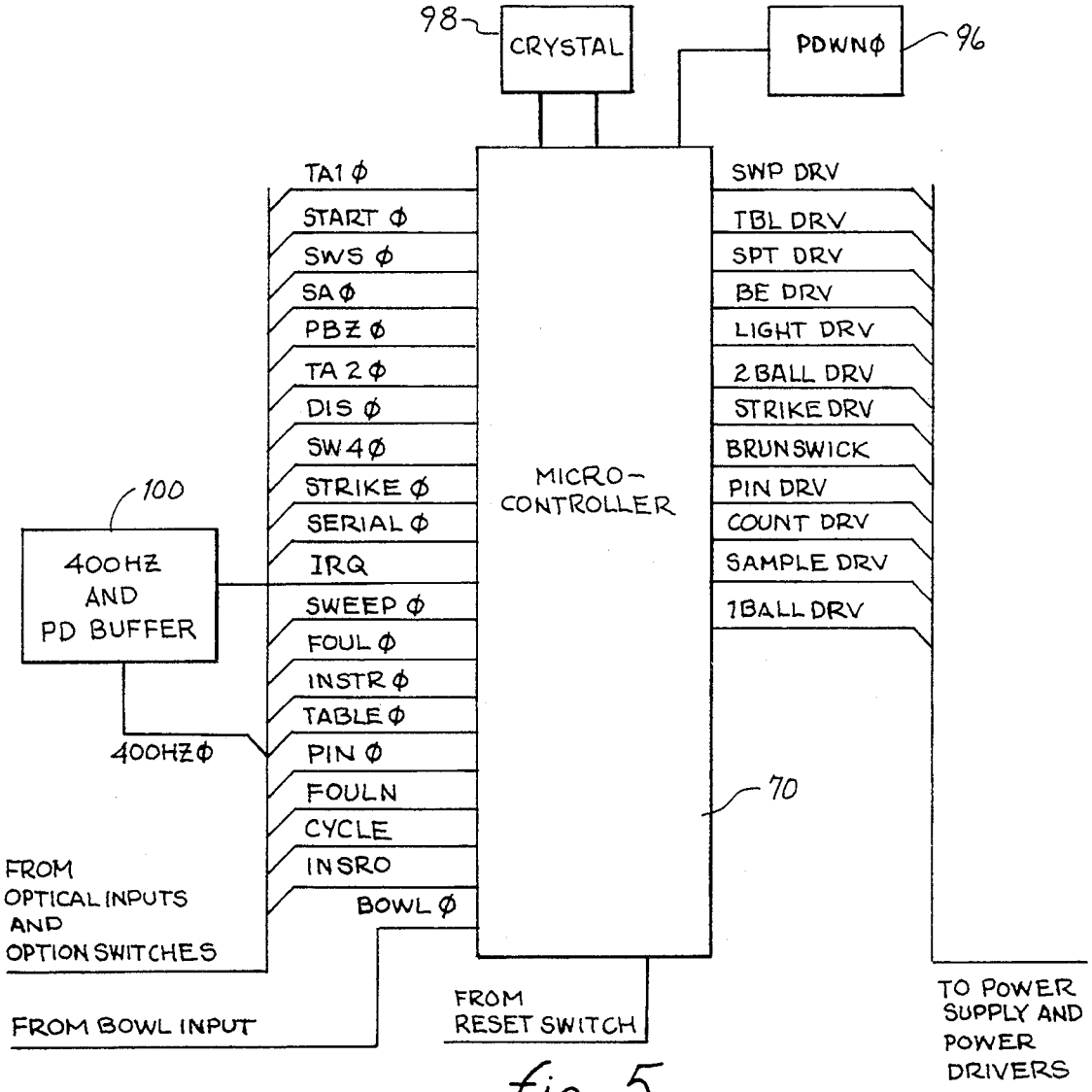
FIG. 5 is a more detailed block diagram of the inputs to and the outputs from the micro-controller shown in FIG. 3.

Referring to FIG. 5, each of the outputs from the optical couplers 78–92 and the option switches 94 are shown as inputs to the micro-controller 70. Note that the 400 HZ0 signal is input to a 400 HZ and power down buffer 100 which interrupts the 400 HZ0 signal during initial system start up, and subsequently delivers the 400 HZ0 signal as IRQ to the micro-controller 70. The IRQ signal is used to strobe the SERIAL0 data for the short strike function of the pinspotter controller 10. A crystal having a typical 4 MHZ frequency is coupled to the micro-controller 70 in order to run the micro-controller 70. Note that the BOWL0 input to the micro-controller 70 is from the manager's switch 28 to provide either the off position or the bowl position of this switch 28. The power down or PDWN0 96 circuitry provides a power down signal PDWN0 from the power supply 102 in FIG. 6 for shutting down the micro-controller 70. The PDWN0 block 96 also includes a reserve power source such as a large capacitor or a battery for providing power to the micro-controller 70 during normal power loss situations. Consequently, when normal power is restored to the pinspotter controller 10, it remembers all status and position data so that the pinspotter and the pinspotter controller 10 are safely returned to service. The outputs from the micro-controller 70 are coupled to either the power supply and power control circuitry 72 or to the power drivers 74 via the power supply and power control circuitry 72. The SWPDRV and TBLDRV signals are used to drive the pinspotter sweep motor 34 and table 32, respectively. The SPTDRV signal drives the spot solenoid 36. The BEDRV signal drives the back end motor 48. The LIGHTDRV signal drives the pit light 40, the 2 BALLDRV signal drives the 2nd ball light 44, the STRIKEDRV signal drives the strike light 46, and the 1 BALLDRV signal drives the 1st ball light 42. The BRUNSWICK signal is a special time delay signal used to signal a Brunswick type scoring system that scoring data is available. The PINDRV signal drives the pin feed solenoid 38. The COUNTDRV drives a counter that keeps track of the number of times that the pinspotter table spots a set of pins. The SAMPLEDRV samples the DISTRIBUTOR switch 22 to determine when the distributor arm is at position 7. The reset input to the micro-controller 70 is from the RESET switch 66.

Figure 6:
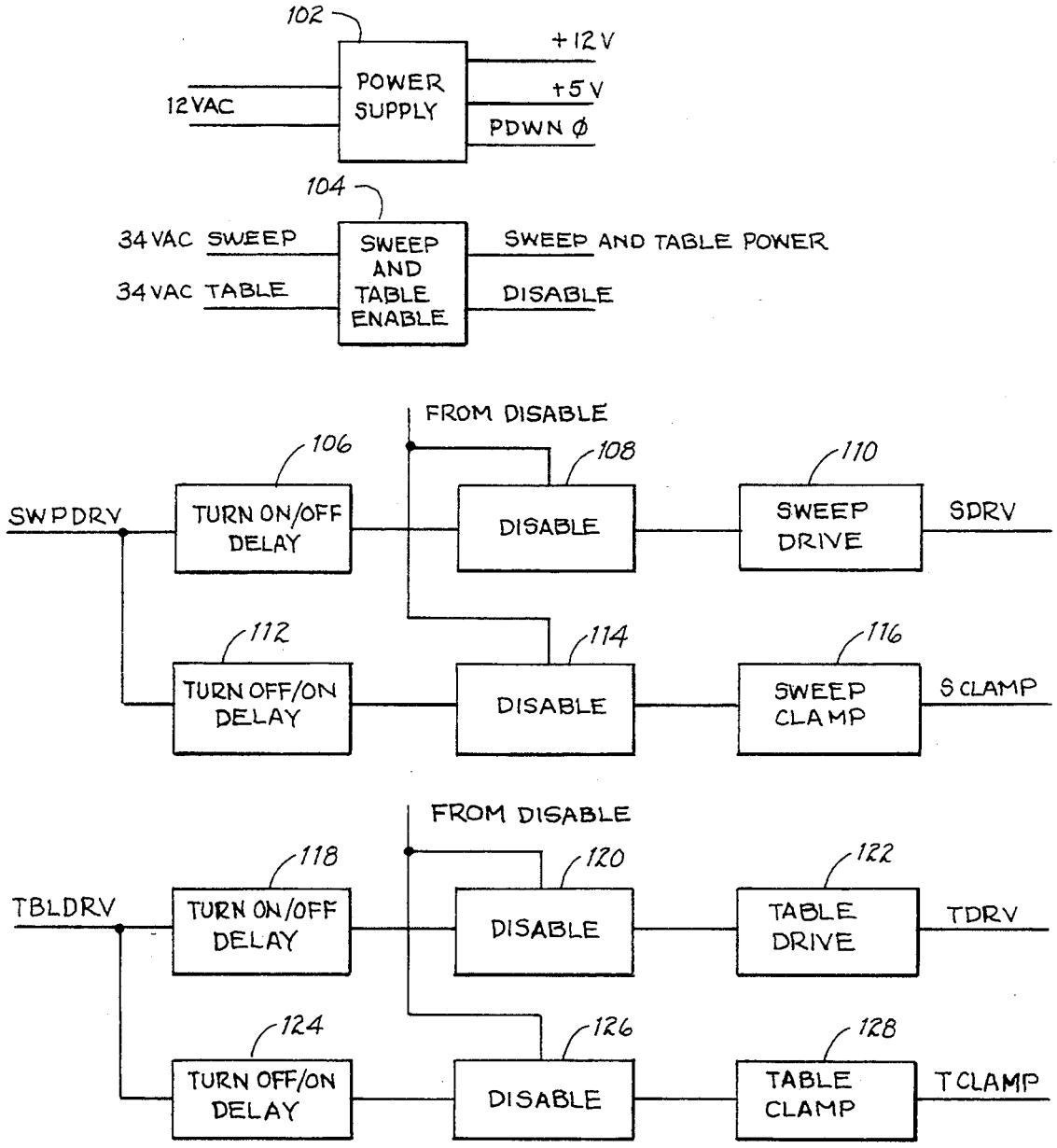
FIG. 6 is a more detailed block diagram of the power supply and power control circuitry shown in FIG. 3.

Referring to FIG. 6, a more detailed view of the power supply and power control circuitry 72 is shown. The power supply 102 receives 12 VAC and converts this to both 12 VDC and 5 VDC. In addition, the power supply 102 provides the PDWN0 signal to the PDWN0 circuitry 96 when system power is secured. The sweep and table enable circuit 104 looks for a 34 VAC SWEEP signal and a 34 VAC TABLE signal. When these signals are present, the pinspotter sweep and table are enabled, and if these signals are not present then the sweep and table are disabled via the DISABLE signal. The turn on/off delay 106, the disable 108, the sweep drive 110, the turn off/on delay 112, the disable 114, and the sweep clamp 116 work in concert to ensure that the sweep is not clamped or held in place when the sweep is being driven, or vice versa. Such an event would be damaging to the pinspotter sweep and the pinspotter controller 10. The turn on/off delay 106 provides a time delay to ensure that sweep clamp power has been removed prior to attempting to drive the sweep. Alternatively, the turn off/on delay 112 provides a time delay to ensure that sweep drive power has been removed prior to attempting to clamp the sweep. The disable circuits 108 and 114 open both the drive and the clamp power supply paths if a DISABLE signal is delivered from the sweep and table enable circuit 104. The sweep drive 110 and the sweep clamp 116 drive the sweep and clamp the sweep, respectively. In a similar manner, the turn on/off delay 118, the disable 120, the table drive 122, the turn off/on delay 124, the disable 126, and the table clamp 128 work in concert to ensure that the table is not clamped or held in place when the table is being driven, or vice versa.

Figure 7:
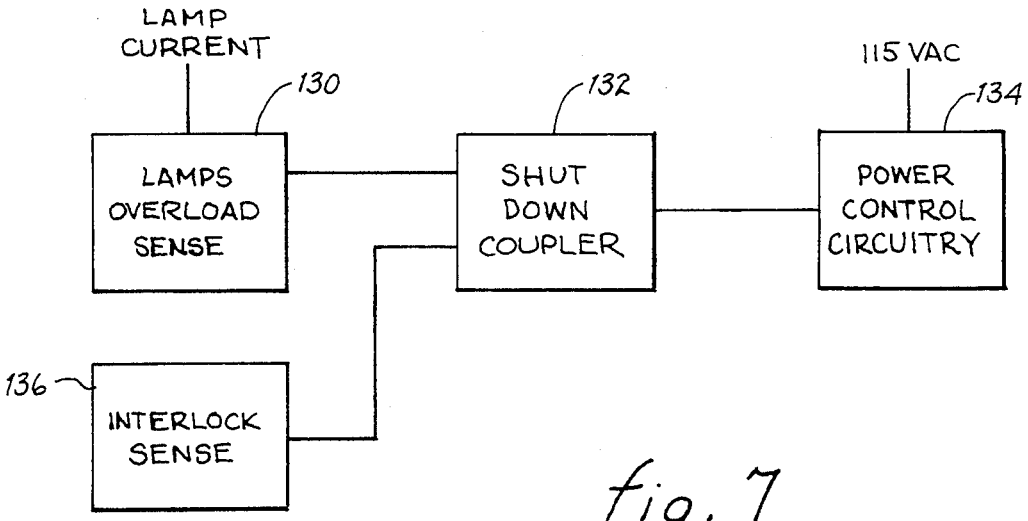
FIG. 7 is a more detailed block diagram of the sense circuitry shown in FIG. 3.

Referring to FIG. 7, a more detailed view of the sense circuitry 76 is shown. The lamps overload sense circuitry 130 detects a current overload to the lamps such as the 1st ball lamp 42, the second ball lamp 44, the strike lamp 46, and the pit lamp 40. The interlock sense circuitry 136 detects a current overload condition via the INTERLOCK switches 30. If either of the lamps overload sense circuitry 130 or the interlock sense circuitry 136 detects a current overload condition, then they send a signal to the shut down coupler 132 which secures power to the pinspotter controller 10 via the power control circuitry 134.

Figure 8:
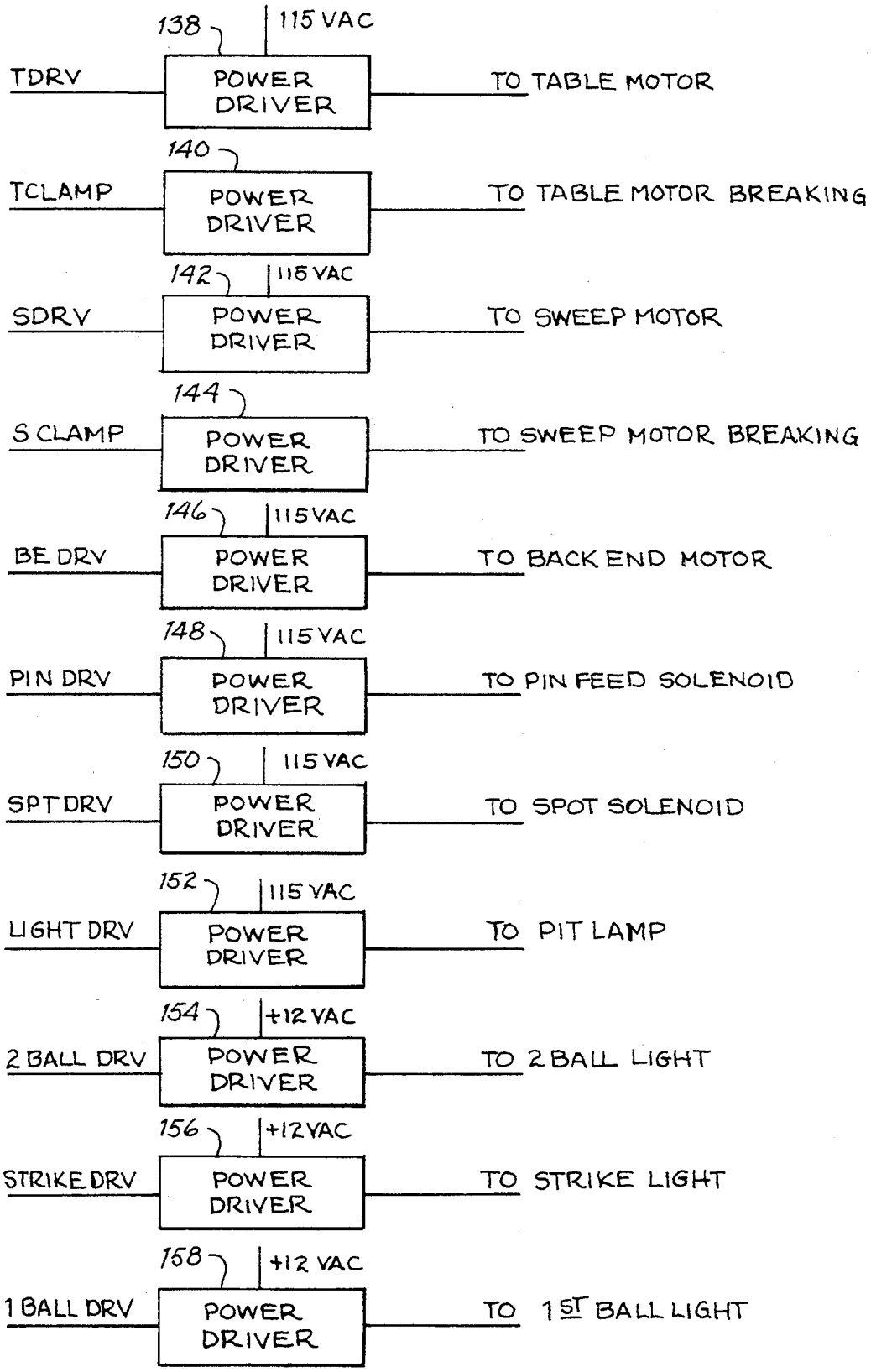
FIG. 8 is a more detailed block diagram of the power drivers shown in FIG. 3.

Referring to FIG. 8, a more detailed view of the power drivers 74 is shown. The TDRV and TCLAMP signals from FIG. 6 are input to power drivers 138 and 140, respectively, to drive the table motor 32 and to stop or break the table motor 32. Again from FIG. 6, the SDRV and SCLAMP signals are input to power drivers 142 and 144, respectively, to drive the sweep motor 34 and to stop or break the sweep motor 34. The remaining input signals, namely BEDRV, PINDRV, SPTDRV, LIGHTDRV, 2 BALLDRV, STRIKEDRV, AND 1 BALLDRV, are driven by their corresponding power drivers 146–158 to drive the back end motor 48, the pin feed solenoid 38, the spot solenoid 36, the pit light 40, the 2nd ball light 44, the strike light 46, and the 1st ball light 42, respectively.

OPERATION

Assuming that a ball has been rolled down the lane and knocked down some of the pins, the ball ultimately impacts against a rear cushion, thereby activating the START switch 14. This action provides the START signal to OC-1 causing the START0 signal to be sent to the micro-controller 70. The micro-controller 70 responds by initiating, in this case, a first ball cycle. Note that the second ball cycle is largely similar to this first ball cycle. The micro-controller 70 first produces the SWPDRV output signal that drives the sweep to the forward, down position. In this position of the sweep, the SWEEP switch 18 sends the SWEEP signal via OC-2 to the micro-controller 70. After a time delay of approximately 2.7 seconds, the table is driven down by the micro-controller 70 output signal TBLDRV. The pin grippers close to pick up the pins, and since the grippers sense pins, there is no strike cycle. If no pins were standing then the STRIKE switch 24 would communicate this data to the micro-controller 70 via OC-5. Note that in this example, the short strike sensor is not considered, however, the short strike operation has been previously disclosed. Since there was no strike, the pinspotter picks up the standing pins. As the table starts up, the sweep is driven back to clear the fallen pins, and then the sweep moves to the forward position where the micro-controller 70 senses the position of the sweep via the SWEEP switch 18 and OC-2. Meanwhile, the table continues to re-spot the remaining pins so that the bowler may play the second ball. When the table is sensed to be at the lower position by the TABLE1 switch 12, it is driven to the top position. When the table is at the top, the TABLE1 switch 12 indicates this information to the micro-controller 70 in order to stop driving the table. As the table moves to its upward position, the sweep also moves up to its home position. When the SWEEP switch 18 indicates that the sweep is at its home position, the micro-controller 70 stops driving the sweep. Once the table and the sweep have returned to their home positions, the second ball light is light and the bowler rolls a second ball to initiate the second ball cycle.

While the invention has been particularly shown and described with reference to the preferred embodiments thereof, it will be understood by those skilled in the art that the foregoing and other changes in form and details may be made therein without departing from the spirit and scope of the invention.

I claim:

1. A combination bowling pinspotter and pinspotter control chassis system comprising, in combination:

a bowling pinspotter having circuit means therein for permitting the spotting of bowling pins; and control chassis means having all solid state components and being coupled to said pinspotter for controlling the operation of said pinspotter comprising, in combination:

means coupled to said control chassis for executing a short strike cycle;

means coupled to a back end motor of said pinspotter for conserving the energy consumed by said back end motor by securing power to said back end motor after it has operated for a predetermined amount of time during which no pins are picked up by said back end motor;

means coupled to a remote control console for permitting said pinspotter to complete a current cycle prior to executing a shut down command for said pinspotter from said remote control console; and means coupled to said control chassis for permitting said control chassis to retain status and position data for said pinspotter during a power interrupt.

2. The system of claim 1 further including scoring interface means coupled to said control chassis for permitting said control chassis to maintain scores for both AMF and Brunswick type scoring systems.

3. The system of claim 1 further including means coupled to said control chassis for controlling the operation of a sweep and a table of said pinspotter.

4. The system of claim 1 wherein said control chassis further includes means coupled to a pin feeding mechanism of said pinspotter for controlling the loading of pins into said pinspotter.

5. The system of claim 1 further including means coupled to said control chassis for permitting a user to shift from a first ball cycle to a second ball cycle and from said second ball cycle to said first ball cycle.

6. The system of claim 1 further including means coupled to said control chassis for inhibiting a foul cycle, for permitting a supervisor to cycle said pinspotter between a bowl mode and an instructo-mat mode, and for inhibiting said instructo-mat mode.

7. The system of claim 1 further including means coupled to said control chassis for providing electrical current overload protection for said control chassis.

8. The system of claim 3 further including interlock control means coupled to said pinspotter for preventing said pinspotter from hitting and damaging said sweep, said interlock control means also preventing simultaneous energizing of a first motor for said sweep and a second motor for said pinspotter.

9. The system of claim 8 wherein said interlock control means prevents said pinspotter from hitting and damaging itself and a bowling pin.

10. The system of claim 1 further including scoring interface means coupled to said control chassis for permitting said control chassis to maintain scores for both AMF and Brunswick type scoring systems; means coupled to said control chassis for controlling the operation of a sweep and a table of said pinspotter; means coupled to a pin feeding mechanism of said pinspotter for controlling the loading of pins into said pinspotter; means coupled to said control chassis for permitting a user to shift from a first ball cycle to a second ball cycle and from said second ball cycle to said first ball cycle; means coupled to said control chassis for inhibiting a foul cycle, for permitting a supervisor to cycle said pinspotter between a bowl mode and an instructo-mat mode, and for inhibiting said instructo-mat mode; means coupled to said control chassis for providing electrical current overload protection for said control chassis; and means coupled to said control chassis for electronically breaking said sweep and said table.

11. A combination AMF 8230 bowling pinspotter and pinspotter control chassis system comprising, in combination:

an AMF 8230 bowling pinspotter having circuit means therein for permitting the spotting of bowling pins; and control chassis means having all solid state components and being coupled to said pinspotter for controlling the operation of said pinspotter comprising, in combination:

means coupled to said control chassis for executing a short strike cycle;

means coupled to a back end motor of said pinspotter for conserving the energy consumed by said back end motor by securing power to said back end motor after it has operated for a predetermined amount of time during which no pins are picked up by said back end motor;

means coupled to a remote control console for permitting said pinspotter to complete a current cycle prior to executing a shut down command for said pinspotter from said remote control console; and means coupled to said control chassis for permitting said control chassis to retain status and position data for said pinspotter during a power interrupt.

12. A method of operating a combination bowling pinspotter and pinspotter control chassis system comprising the steps of:

providing a bowling pinspotter having circuit means therein for permitting the spotting of bowling pins; and providing control chassis means having all solid state components and being coupled to said pinspotter for controlling the operation of said pinspotter comprising the steps of:

providing means coupled to said control chassis for executing a short strike cycle;

providing means coupled to a back end motor of said pinspotter for conserving the energy consumed by said back end motor by securing power to said back end motor after it has operated for a predetermined amount of time during which no pins are picked up by said back end motor;

providing means coupled to a remote control console for permitting said pinspotter to complete a current cycle prior to executing a shut down command for said pinspotter from said remote control console; and providing means coupled to said control chassis for permitting said control chassis to retain status and position data for said pinspotter during a power interrupt.

13. The method of claim 12 further including scoring interface means coupled to said control chassis for permitting said control chassis to maintain scores for both AMF and Brunswick type scoring systems.

14. The method of claim 12 further including means coupled to said control chassis for controlling the operation of a sweep and a table of said pinspotter.

15. The method of claim 12 wherein said control chassis further includes means coupled to a pin feeding mechanism of said pinspotter for controlling the loading of pins into said pinspotter.

16. The method of claim 12 further including means coupled to said control chassis for permitting a user to shift from a first ball cycle to a second ball cycle and from said second ball cycle to said first ball cycle.

17. The method of claim 12 further including means coupled to said control chassis for inhibiting a foul cycle, for permitting a supervisor to cycle said pinspotter between a bowl mode and an instructo-mat mode, and for inhibiting said instructo-mat mode.

18. The method of claim 12 further including means coupled to said control chassis for providing electrical current overload protection for said control chassis.

19. The method of claim 14 further including interlock control means coupled to said pinspotter for preventing said pinspotter from hitting and damaging said sweep, said interlock control means also preventing simultaneous energizing of a first motor for said sweep and a second motor for said pinspotter.

20. The method of claim 19 wherein said interlock control means prevents said pinspotter from hitting and damaging itself and a bowling pin.

* * * * *